US005284338A

United States Patent [19]

Allmendinger et al.

[11] Patent Number: 5,284,338

[45] Date of Patent: Feb. 8, 1994

[54] DEVICE FOR ALIGNING INDIVIDUALLY SUPPLIED SHEETS

[75] Inventors: Franz Allmendinger, Eichwald; Markus Weber, Esslingen, both of Fed. Rep. of Germany

[73] Assignee: Eastman Kodak Company, Rochester, N.Y.

[21] Appl. No.: 23,408

[22] Filed: Feb. 26, 1993

[30] Foreign Application Priority Data

Mar. 6, 1992 [DE] Fed. Rep. of Germany ..... 4207070

[51] Int. Cl.[5] ..... B65H 31/26

[52] U.S. Cl. ..... 271/220

[58] Field of Search ..... 271/220, 221, 222, 314, 271/184, 236, 250

[56] References Cited

U.S. PATENT DOCUMENTS 5,120,046 6/1992 Mandel et al. ..... 271/220
5,197,728 3/1993 Radtke ..... 271/220
5,199,703 4/1993 Hess ..... 271/314

FOREIGN PATENT DOCUMENTS 4101381 7/1992 Fed. Rep. of Germany ..... B65H 29/00
63-267666 11/1988 Japan ..... 271/220
3128858 5/1991 Japan ..... 271/220

*Primary Examiner*—David H. Bollinger
*Attorney, Agent, or Firm*—Lawrence P. Kessler

[57] ABSTRACT

A device for aligning supplied sheets into a stack in a collecting tray includes a pivotable arm that has a free end. First and second drivable wheels are mounted at the free end of the pivotable arm for contacting each supplied sheet to be aligned. A lifting device including an electromagnet is connected to the pivotable arm for lifting the pivotable arm, and a control device is connected to the electromagnet for selectively controlling lifting and lowering of the pivotable arm and first and second drivable wheels.

5 Claims, 4 Drawing Sheets

DEVICE FOR ALIGNING INDIVIDUALLY SUPPLIED SHEETS

CROSS-REFERENCE TO RELATED APPLICATION

This application is related to commonly assigned U.S. application Ser. No. 07/799,226, filed Nov. 27, 1991 in the name of Werner Hess and entitled DEVICE FOR STACKING AND ALIGNING INDIVIDUALLY SUPPLIED SHEETS.

BACKGROUND OF THE INVENTION

1. Technical Field

The invention relates to a device for aligning sheets which are individually supplied to a collecting tray in which they are stacked one above the other. In particular, copy sheets produced by a copier whose collecting tray comprises a depositing surface and a lateral limiting wall arranged in parallel with the direction of entrance of the sheets as well as an abutment associated with the front end sides of the sheets. The device includes two drivable wheels which are mounted about a common shaft at the free end of a pivotable arm and rest on the incoming sheet so as to align the sheet with respect to both the lateral limiting wall and the front abutment. The first wheel is mounted for rotation on a collar arranged on a rotary sleeve eccentrically with respect to the shaft, and the second wheel is mounted for rotation on a collar arranged on the sleeve concentrically with the shaft. The second wheel in addition is held in positive engagement with the sleeve which is shiftable on the shaft and is permanently held in positive engagement with a rotatably mounted and drivable coupling portion.

2. Background Art

In prior art aligning devices driven wheels which influence the incoming sheets permanently rest on the depositing surface of the collecting tray and the sheets accumulated in the tray respectively. As such, wear is relatively high, particularly on any such wheel that has a high-friction coating. Moreover, due to a pulse-type mode of operation of such devices the contact pressure of the wheels varies so that transport disturbances can occur.

SUMMARY OF THE INVENTION

It is the object of the invention to design an aligning device of the generic type such that wear is reduced and a reliable mode of operation ensured.

It is also an object of the invention to design an aligning device of the generic type such that the contact pressure of the aligning wheels is held as constant as possible.

According to the invention this object is attained in that:

- the pivotable arm is engaged by a lifting device which lifts the driven wheels from the depositing surface of the collecting tray and the sheet stack respectively;
- a sensor of a control device positioned in the path of the incoming sheets can control the lifting device such that when a sheet arrives the wheels are movable from a raised position to a position in which they are lowered onto the arrived sheet; and
- the lifting device lifts the wheels off the aligned sheet after several alignment operations whose number or duration is preset by the control device.

According to the invention this object is also attained in that a leaf spring provided in the depositing surface of the collecting tray projects above the depositing surface and is arranged opposite the wheels and in the direction of sheet entrance. One end of the spring extends in the direction opposite to the sheet entrance and is fixed in a position below the depositing surface of the collecting tray. The other end, which extends opposite thereto in the direction of sheet entrance, is arranged in parallel with the depositing surface and projects above the surface.

According to an advantageous modification of the invention the upward and downward movements of the arm are braked, which results in both a more uniform contact pressure of the wheels and in an additional attenuation of the dropping movement of the arm after it has been released by the lifting device which is designed as an electromagnet.

According to a further useful modification of the invention the end of the leaf spring projecting above the depositing surface is roughened on its surface facing the wheels so that the frictional conditions between the first sheet and the roughened surface are adapted to those prevailing between the individual sheets.

The device according to the invention allows in an advantageous manner the contact pressure of the aligning wheels on the sheets to be held substantially constant by the leaf spring which is arranged below the sheet stack and compensates for variations in contact pressure by yielding resiliently as well as by the braking means acting on the surface of the sheet stack.

Particularly advantageously the device is moved from its raised position to its operative position only if a sheet to be aligned has arrived. The lowering of the device is electromagnetically influenced and attenuated by a braking spring such that the aligning wheels are brought into functionally correct engagement immediately upon their contact with the sheet.

According to a further advantageous modification of the invention the lowering movement of the aligning device is limited by a stationary abutment such that rebounding of the dropping aligning wheels, and associated disturbances in the aligning operation, are avoided.

BRIEF DESCRIPTION OF THE DRAWINGS

Further features and advantages can be inferred from the description of embodiments of the invention illustrated in the drawings and from the subclaims. The drawings show schematically in FIG. 1 a plan view, partially in section, of the device without the lifting and braking means;

DETAILED DESCRIPTION OF THE PREFERRED EMBODIMENT

Figure 1:
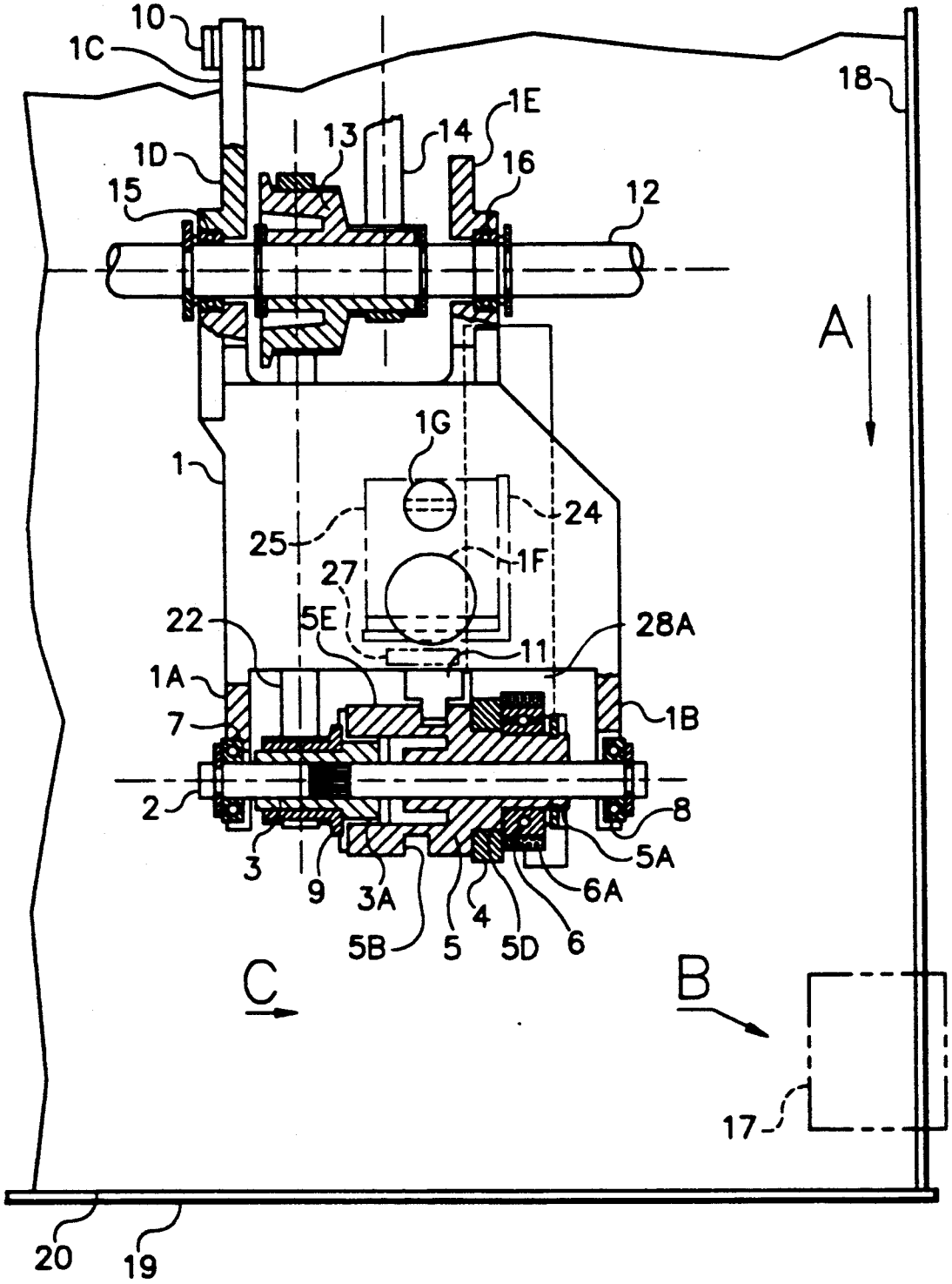

The sheet aligning device according to the invention is part of a type of finisher wherein individually supplied sheets, in particular copy sheets produced by a copier, are collected in a collecting tray 20 and stapled in sets by a stapling device 17.

Of the finisher which is attached to a copier (not illustrated), only those parts are shown as are necessary to understand the invention.

Sheets are fed in the direction of the arrow "A" into the collecting tray 20, which is inclined in the sheet entrance direction, and are deposited in the tray to form a sheet stack 21. During feeding the individual sheets are moved into the operative range of an aligning device (to be described further below) which places the sheets in contact with a front abutment 19 and a lateral limiting wall 18. This alignment takes place within the operative range of a stapling device 17 of known design whose position is indicated in dash-dotted lines.

Above collecting tray 20, an arm 1 is mounted on ball bearings 15, 16 for pivotal movement about a shaft 12 and held in positive engagement with the shaft by means of integrally formed U-shaped webs 1*d*, 1*e*.

Shaft 12 is mounted for rotary movement on a cover 23 arranged above collecting tray 20. Cover 23 of which only the free end necessary for understanding the invention is illustrated, is pivotally hinged to collecting tray 20 at its opposite end as seen in the opposite direction of arrow "A". Cover 23 is pivotable from a lower operative position shown in dash-dotted lines, in which it rests against an abutment (not illustrated), to an upper position.

Between the U-shaped webs 1*d*, 1*e* of arm 1, a first driving wheel 13 is mounted for rotation. The wheel 13 is being driven by a first driving means 14 and is engaged by a second driving means 22.

The second driving means 22 drives a second driving wheel 9 which is rigidly connected with a coupling portion 3 and is fixed to a shaft 2 mounted on the free end of arm 1. Shaft 2 is also mounted on ball bearings 7 and 8 and positively held by snap connections on outriggers 1*a*, 1*b* of arm 1.

Coupling portion 3 is provided with grooves 3*a* which are positively engaged by claws 5*e* of a sleeve 5.

Sleeve 5 can be shifted on shaft 2 and comprises on its circumferential surface an endless cam groove 5*b* with a forward and reverse pitch in the shifting direction. Received in groove 5*b* is a projection 11 which is stationarily mounted on arm 1. Sleeve 5 has a concentric collar 5*d* directly followed by an eccentric collar 5*a*.

A second wheel 4 shiftably mounted on the concentric collar 5*d* has diametrically arranged indentations 4*a* for receiving diametrically arranged entrainment members 5*c* which are attached to sleeve 5. The entrainment members 5*c* which are provided with rounded ends engage inclined surfaces 4*b* of the indentations 4*a*, which are arranged in the path of movement of the entrainment members 5*c*. The outer circumference of the second wheel 4 has a smooth surface for a low coefficient of friction.

A first wheel 6 designed as a radial ball bearing is arranged on the eccentric collar 5*a* of sleeve 5, its inner ring being firmly seated on collar 5*a* and the outer circumference of its outer ring being provided with a coating 6*a* of high static friction for a high coefficient of friction. The wheels 4 and 6 have about the same diameters.

Arm 1 is provided with an integral element 1*c* which is associated with a light barrier 10.

A low-bias spring (not illustrated) which engages arm 1 and rests against cover 23 biases arm 1 counterclockwise.

Front abutment 19 of collecting tray 20 is mounted for pivotal movement about a journal 19*a* and movable in the direction of the arrow "D" by an electromagnet (not illustrated).

Figure 2:
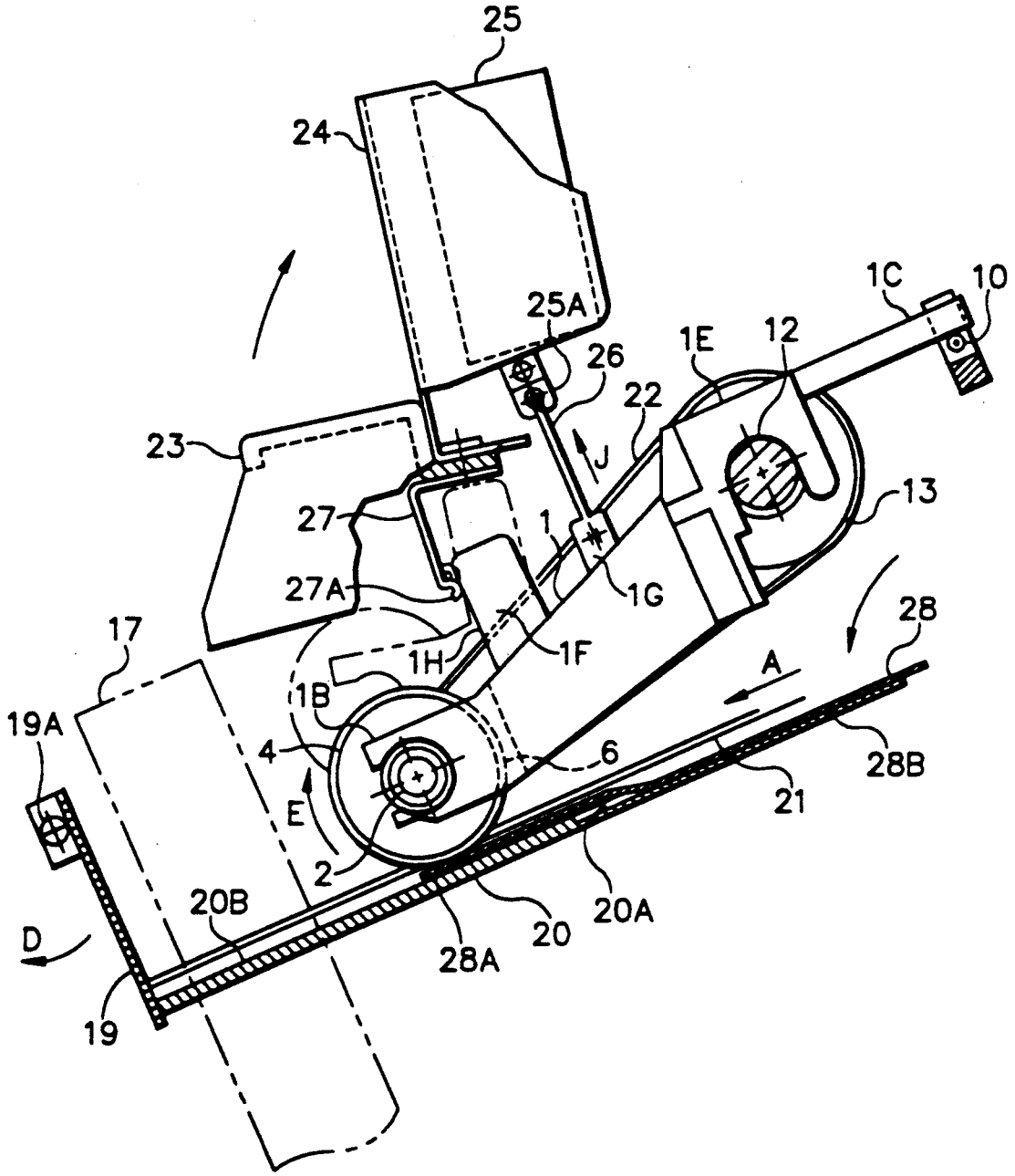
FIG. 2 a lateral view of the device according to FIG. 1, including the lifting and braking means.

An electromagnet 25 positioned above arm 1 is attached to the upper surface of cover 23 by means of a holder 24 (see FIG. 2). The armature 25*a* of electromagnet 25, which is movable approximately vertically to the depositing surface 20*b* of collecting tray 20 in the direction of the arrow "J", is hingedly connected with a projection 1*g* of arm 1 via a rod 26.

Attached to the lower surface of cover 23 is a braking spring 27 one spring arm 27*a* of which is held in frictional contact with a projection 1*f* of arm 1. Projection 1*f* which is provided on the upper surface of arm 1 is arranged in that area of arm 1 which is associated with the wheels 4 and 6. The surface 1*h* of projection 1*f*, which faces the wheels 4 and 6, is straight and has a length which allows spring arm 27*a* of braking spring 27 to contact projection 1*f* in any possible angular position of arm 1. As can be inferred from FIG. 2 the position of surface 1*h*, and thus the distance of the contact point from spring arm 27*a* and the axis of rotation of shaft 12 varies depending on the angular position of arm 1. This causes the spring bias of braking spring 27 to increase when arm 1 drops from its raised position indicated in dash-dotted lines to its operative position shown in FIG. 1 whereby said arm is braked as the braking action increases.

A leaf spring 28, shown in particular in FIGS. 1 and 2, is arranged on depositing surface 20*b*. One end 28*b* of that spring is mounted in a lower section 20*a* of collecting tray 20 such that it does not project above the depositing surface 20*b* thereof.

The other end 28*a* of leaf spring 28 projects above, and extends in parallel with surface 20*b*. The transition from one end 28*b* to the other end 28*a* represents an inclined surface rising in the direction of the arrow "A". The projecting end 28*a* as shown in FIG. 1 is at least as broad as the adjacently arranged wheels 4 and 6 and is arranged directly opposite them. The surface of end 28*a*, which faces the wheels 4 and 6, is roughened in order that the frictional conditions be adapted to the friction prevailing between the sheets. This results in constant conditions during the entire alignment operation and, moreover, in that the sheet stack 21 is prevented from slipping on its depositing surface 20*b* which is substantially smooth. As can be seen in FIG. 2, the projecting end 28*a*—as seen in the direction of the arrow "A" —extends from an area in front of the wheels 4 and 6 to a point beyond the contact zone of the wheels 4 and 6. The projecting end 28*a* is spaced from the depositing surface 20*b* by a distance of, e.g. 1.5 to 2 mm so that end 28*a* can freely oscillate.

The device functions as follows:

When the finisher is switched on, electromagnet 25 is activated. Its armature 25*a* attracts rod 26 in the direction of the arrow "J" and thus moves arm 1 along with the wheels 4 and 6 to the position indicated in dash-dotted lines in FIG. 2. The constantly driven wheels 4 and 6 are thus in a position defined by the stationary mount of cover 23, in which they are lifted above the maximum height of sheet stack 21 so that sheets arriving under the action of gravity in the direction of the arrow "A" can slide without hindrance into contact with front abutment 19.

A sensor (not illustrated) arranged in the path of movement of a sheet arriving in the direction of the arrow "A" senses the leading edge of the sheet and triggers a control device of a type known per se and not illustrated. Following a predetermined interval the control device switches off the electromagnet 25 which thus releases arm 1 so that the arm can drop. During the dropping movement of arm 1, electromagnet 25 is temporarily activated by the control device so that it is braked before the wheels 4 and 6 contact the end 28*a* of the leaf spring or sheets already deposited. The point of contact of the wheels 4 and 6 is chosen such that the incoming sheet has already arrived below the wheels 4 and 6.

The electromagnetically influenced braking of the dropping movement is assisted by braking spring 27, 27*a* which becomes operative during the dropping operation. With the braking action increasing this constantly effective braking spring 27 influences, as mentioned before, surface 1*h* such that the wheels 4 and 6 contact the sheets at low speed. The wheels are thus prevented from contacting the sheet to be aligned with a high impact and a rebound effect and resultant functional disturbances during the aligning operation are avoided. Thanks to the braking operation, the wheels 4 and 6 can function as desired as soon as they contact the sheet to be aligned.

The actual alignment operation takes place after the wheels 4 and 6 have contacted the sheets under the action of gravity and the influence of the aforementioned low-bias spring:

Coupling portion 3 made to rotate by the driving means 14 and 22 entrains sleeve 5 and the second wheel 4 held in positive engagement with said portion while rotating in the direction of the arrow "E". The rotating sleeve 5 slides with its endless cam groove 5*b* along the stationary projection 11 and is thus once moved to and fro along shaft 2 during each revolution.

During each revolution of sleeve 5 the first and the second wheel 6 and 4 respectively is alternately brought into engagement with a sheet such that during the first half of the revolution of sleeve 5 only the second wheel 4 rests on the sheet while the first wheel 6 is raised owing to its eccentricity, whereas during the second half of the revolution the first wheel 6 rests on the sheet and raises the second wheel 4 owing to its eccentricity.

The eccentric collar 5*a* of sleeve 5 is arranged with respect to the pitch of the endless cam groove 5*b* such that when sleeve 5 is moved by the pitch of cam groove 5*b* in the direction of the arrow "F" the second wheel 4 rests on the uppermost sheet and the first wheel 6 is raised. Due to the fact that the second wheel 4 rests on the uppermost sheet, relative torsion occurs between said wheel and the rotating sleeve 5. As a result, the entrainment members 5*c* move into contact with the inclined surfaces 4*b* of the second wheel 4, urge said wheel into contact with the outer ring of the first wheel 6 and entrain the first wheel frictionally while rotating in the direction of the arrow "E".

When put in motion the second wheel 6 is lowered onto a sheet arriving in the collecting tray 20 in the direction of the arrow "A" during the second half of each revolution of sleeve 5, during which a shifting movement occurs in the direction of the arrow "C", and moves said sheet in the direction of the arrow "B" (see FIG. 1) both to the front abutment 19 and towards the lateral limiting wall 18. As indicated by the arrow "B", the alignment movement is substantially towards the lateral limiting wall 18 while the transport stroke in the direction of the arrow "A" is smaller each time.

Since the second wheel 4 is raised when the first wheel 6 is held in engagement, the relative torsion of the second wheel 4 is discontinued so that it is no longer frictionally engaged with the first wheel 6. Hence, the first wheel 6 only influences the sheet to be aligned through the released driving motion of its mass so that when the sheet has reached its end position at the front abutment 19 and at the lateral limiting wall 18 respectively, it is no longer shifted unnecessarily and buckling is avoided.

When the first wheel 6 has been rotated far enough for its operative circumferential surface to move, (as a result of its eccentricity), behind the outer circumference of the second wheel 4, the device rests with the smooth surface of its second wheel 4 on the uppermost sheet while sleeve 5 slides back in the direction of the arrow "F" to the point of return of cam groove 5*b* and subsequently resumes its shifting movement in the direction of the arrow "C". During this, the first wheel 6 is put in motion as described and then carries out its transport function.

When arriving in the direction of the arrow "A" the sheets to be aligned are repeatedly advanced by short pulse-type movements until they have reached their end position. During such pulse-type transport movements each sheet is advanced by short distances of, e.g. 4 to 5 mm only so that it is not buckled when it reaches its end position.

Thanks to the pulse-type mode of operation of the device, in which the two wheels 4 and 6 are alternately brought into engagement, the contact pressure of the wheels 4 and 6 is constantly changed. This may result in transport disturbances caused by lack of contact pressure.

In order to avoid such disturbances the aforedescribed leaf spring 28 is provided whose freely oscillating end 28*a* compensates for the variations in the contact pressure of the wheels 4 and 6 by yielding resiliently. Leaf spring 28 which is made from spring steel has an inherent frequency high enough to enable the spring to follow the less frequent oscillations of the aligning device 1, 4, 6.

The first wheel 6 is brought into engagement with a sheet in the manner described only if sleeve 5 is moved by the rising cam section of cam groove 5*b* in the direction of the arrow "C". In this manner, the sheet to be aligned is engaged intermittently and transporting in the direction of the arrow "B" while it is released again and again between the transport phases by the lifting of the first wheel 6 so that stress leading to buckling can be relieved.

Moreover, only the entrainment action of the released mass of the first wheel 6 is effective during the transport phase for aligning the sheet. Since, in addition, the area of engagement of the second wheel 6 with the sheet is located near the sheet edges to be aligned the sheet is effectively protected against kinking. All of these provisions result in that the sheets are aligned reliably and promptly, and in particular that tension building up during alignment and leading to buckling can be relieved in the phases of rising movement of the first wheel 6 so that the sheets can be stacked in a plane position and precisely in register with each other.

After a number or period of aligning pulses in the direction of the arrow "B" preset by the control device electromagnet 25 is activated and lifts arm 1 and thus the wheels 4 and 6 off the aligned sheet. Consequently, the wheels 4 and 6 are only held in engagement for the period required for aligning a sheet and unnecessary wear, in particular of the friction coating 6a of the eccentrically mounted wheel 6, is avoided.

The sheets thus reliably deposited and aligned can subsequently be stapled by the stapling device 17 to form a properly aligned set.

When the front abutment 19 is opened in the direction of the arrow "D" the stapled sheet stack 21 can be released for transport to an output tray attached to the finisher and not illustrated.

In order that the accumulated height of the sheet stack 21 should not exceed the stack height which can be handled without problem by the stapling device 17 a stack-height limiting device is provided.

That limiting device includes a stationary fork-shaped light barrier 10 adapted to receive an element 1c molded to arm 1 of the aligning device. As soon as the maximum stack height has been reached, element 1c covers light barrier 10, which interrupts further transport of the sheets. Since element 1c is integral with arm 1 the stack height can be advantageously measured by the alignment device which rests under the action of gravity on sheet stack 21 while the sheet stack 21 is compressed, so that measurement occurs under the conditions required for functionally proper stapling of the sheets.

Figure 3:
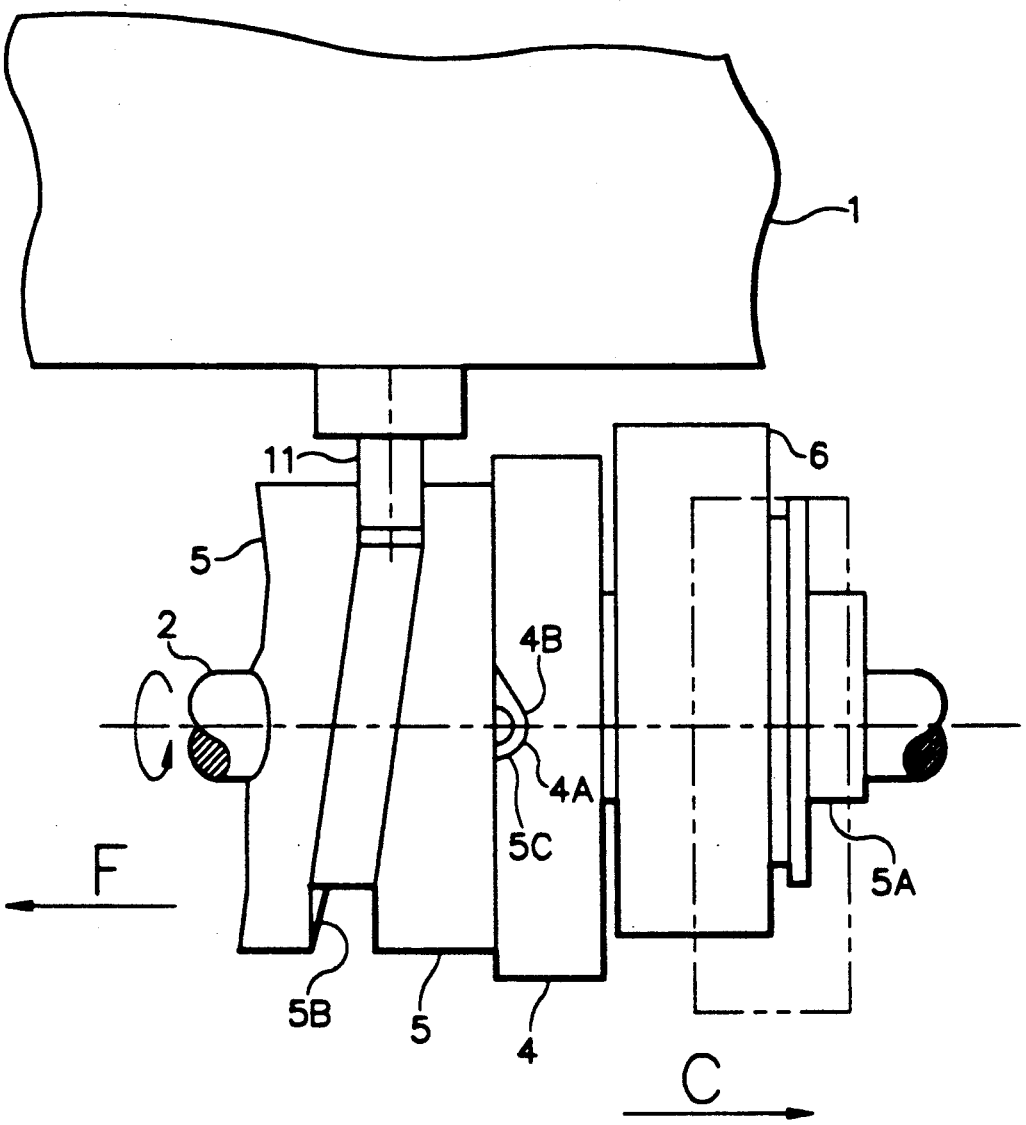
FIG. 3 a partial, enlarged view of the device according to FIG. 1.

A second embodiment described with reference to FIGS. 4 and 5 serves to enhance the frictional engagement between the first and the second wheel 6 and 4 respectively. In contrast to the embodiment according to FIGS. 1 to 3, the projection 11 and the second wheel 4 are designed in a different manner.

Figure 4:
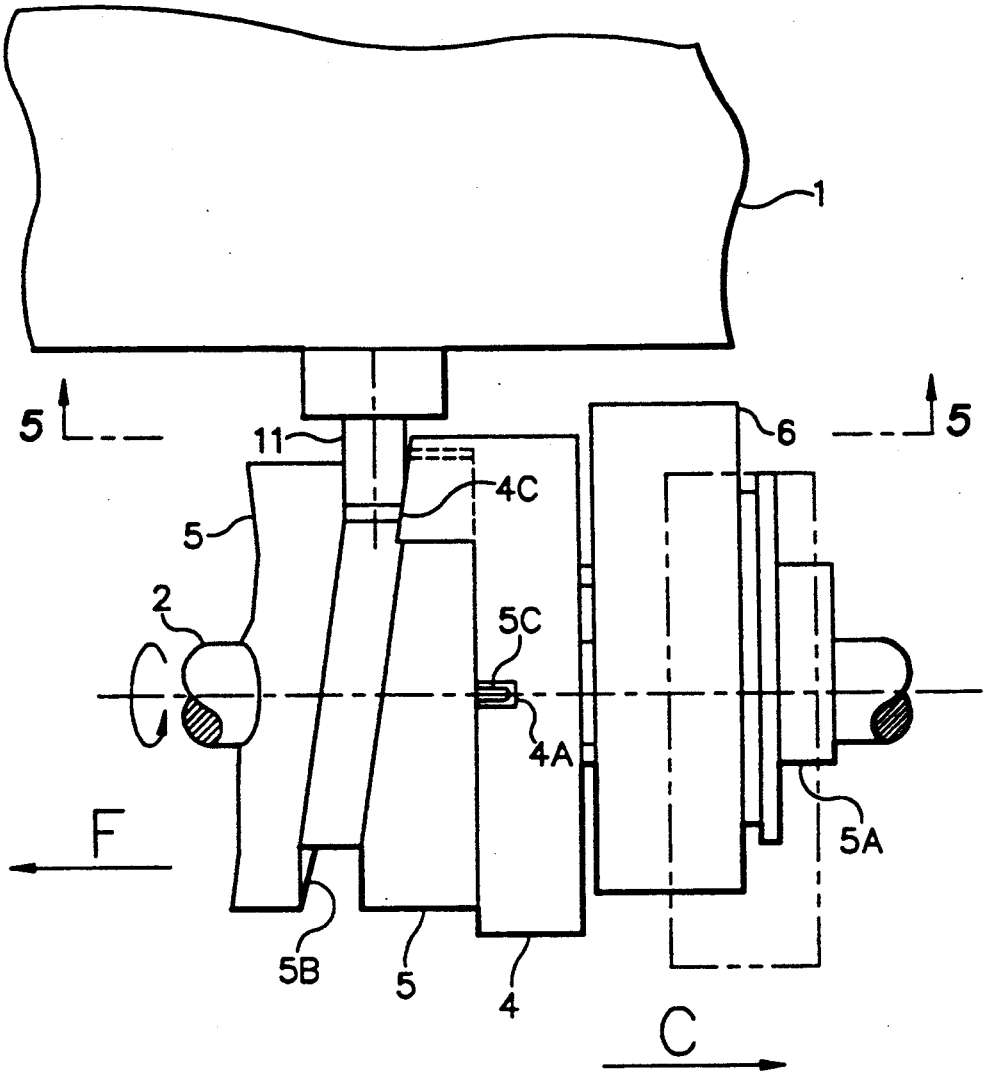
FIG. 4 a partial, enlarged view of an embodiment of the device according to FIG. 1.
Figure 5:
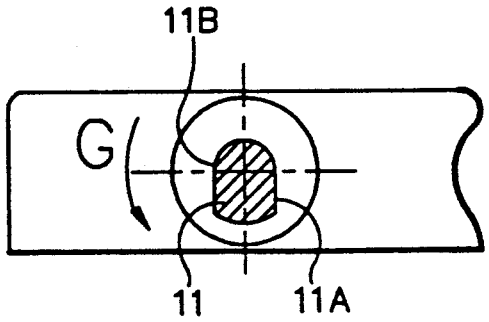
FIG. 5 a partial sectional view of the device along line A—A in FIG. 4.

Projection 11 according to FIG. 4 is mounted for rotation about its longitudinal axis in arm 1 and is biased to rotate in the direction of the arrow "G" by a spring (not illustrated) see FIG. 5. The portion of projection 11 that is received in cam groove 5b has flattened sides 11a, 11b frictionally engaging the walls of cam groove 5b.

The second wheel 4 of this embodiment according to FIG. 4 is also provided with indentations 4a which enable the wheel via entrainment elements 5c to be brought into positive engagement with sleeve 5 and to be shifted in the direction of the arrow "C". The shifting movement is carried out via an inclined surface 4c arranged on the second wheel 4, said inclined surface extending into the path of movement of projection 11 and held in engagement with projection 11 and its side 11a respectively rather than with the cam groove 5b cut out in that area. The inclined surface 4c which is designed as a circular arc segment and extends around sleeve 5 is adapted to the shape of cam groove 5b.

The modified device according to FIGS. 4 and 5 functions as follows:

If during rotation of sleeve 5 projection 11 reaches the inclined surface 4c the torque of projection 11 caused by its spring is transmitted to the second wheel 4 and frictionally urges said wheel into contact with the first wheel 6. As a result of such frictional engagement, the first wheel 6 is entrained and made to rotate, the frictional engagement being discontinued when the projection leaves the inclined surface 4c so that the first wheel 6 exclusively influences the sheet to be aligned by the driving movement released by such entrainment.

Owing to the spring-biased torque of projection 11, its sides 11a, 11b permanently rest against the walls of cam groove 5b. In this way, the inclined surface 4c is reliably urged aside so that the frictional engagement between the second and the first wheel 4 and 6 respectively occurs under constant conditions.

In contrast to the embodiment according to FIGS. 1 and 2, shaft 2 can also be driven in that the driving motor is arranged at the free end of arm 1 (not illustrated) and drives shaft 2 directly. Using a drive thus designed oscillations or movements caused by driving means are avoided so that a smooth operation of the aligning device is achieved.

In contrast to the embodiment described in which the dropping of arm 1 and the wheels 4 and 6 is braked by electromagnetic means the lowering movement of the wheels 4 and 6 can also be limited by an abutment arranged on cover 23 and not illustrated. The abutment is positioned in the path of movement of armature 25a of electromagnet 25 such that the wheels 4 and 6 while contacting the end 28a of leaf spring 28 in their operative position do not allow that end to rest on the depositing surface 20b. Hence, the abutment also prevents the wheels 4 and 6 from impacting the sheets at high speed and rebounding and thus helps to avoid disadvantageous functional disturbances during the aligning operation. As the sheet stack 21 becomes higher, the abutment is rendered inoperative but the air cushion between the accumulated sheets attenuates the impact of the wheels 4 and 6 to such an extent that functional disturbances are excluded. Moreover, the braking spring 27 shown in FIG. 2 may also be used for attenuation in this modified embodiment.

In a further embodiment not illustrated, the electromagnetic braking of the lowering movement is used in combination with the abutment limiting such movement. In such a case the alignment device 1, 4, 6 is braked when moving into contact with the abutment.

The invention has been described in detail with particular reference to preferred embodiments thereof, but it will be understood that variations and modifications can be effected within the spirit and scope of the invention.

What is claimed is:

1. A device for aligning sheets which are supplied individually to a collecting tray that has a depositing surface including a lateral limiting wall and an abutment associated with a front end thereof relative to the direction of sheet entrance, the aligning device comprising:

(a) a pivotable arm having a free end for resting on an incoming sheet to align the sheet with respect to both the lateral limiting wall and the abutment;

(b) first and second drivable wheels mounted about a common shaft at said free end of said pivotable arm;

(c) a lifting mechanism connected to said pivotable arm for lifting said pivotable arm and said first and second wheels off a stack of aligned sheets on the depositing surface of the collecting tray; and (d) a control device connected to said lifting mechanism for maintaining said pivotable arm and said first and second wheels in a raised position and for moving the same to a lowered position when a sheet is being supplied onto the depositing surface so as to contact and align such sheet.

2. The aligning device of claim 1 including a leaf spring mounted in the depositing surface of the collecting tray, said leaf spring projecting above the depositing surface and at a location directly opposite a lowered position of said first and second wheels.

3. The aligning device of claim 1 including braking means for inhibiting upward and downward movement of said pivotable arm.

4. The aligning device of claim 1 wherein said lifting device comprises an electromagnet connected to said pivotable arm for acting vertically above the depositing surface on said pivotable arm.

5. The aligning device of claim 4 wherein said electromagnet is mounted on a cover member that is pivotably hinged above the collecting tray.

* * * * *